US008794001B2

(12) United States Patent
Tsuboi et al.

(10) Patent No.: US 8,794,001 B2
(45) Date of Patent: Aug. 5, 2014

(54) POWER GENERATION APPARATUS

(75) Inventors: Noboru Tsuboi, Kako-gun (JP); Masayoshi Matsumura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 172 days.

(21) Appl. No.: 13/471,830

(22) Filed: May 15, 2012

(65) Prior Publication Data

US 2012/0312021 A1 Dec. 13, 2012

(30) Foreign Application Priority Data

Jun. 9, 2011 (JP) ..... 2011-129409

(51) Int. Cl.
*F01K 13/02* (2006.01)

(52) U.S. Cl.
USPC ..... 60/646; 60/516; 60/530; 60/531; 60/643; 60/645; 60/657; 60/660; 60/661; 60/667

(58) Field of Classification Search
USPC ..... 60/516, 530, 531, 643, 660, 667, 646, 60/657, 645, 661
See application file for complete search history.

(56) References Cited

U.S. PATENT DOCUMENTS 6,981,377 B2 * 1/2006 Vaynberg et al. ..... 60/641.8
2003/0213246 A1 * 11/2003 Coll et al. ..... 60/653
2005/0183421 A1 8/2005 Vaynberg et al.
2006/0112693 A1 * 6/2006 Sundel ..... 60/670
2009/0071156 A1 * 3/2009 Nishikawa et al. ..... 60/660
2009/0320477 A1 * 12/2009 Juchymenko ..... 60/651
2012/0042650 A1 * 2/2012 Ernst et al. ..... 60/615
2013/0000304 A1 1/2013 Tsuboi et al.

FOREIGN PATENT DOCUMENTS

DE 100 04 187 C1 10/2001
JP 4557793 7/2010

OTHER PUBLICATIONS

Extended European Search Report issued Oct. 19, 2012 in Patent Application No. 12169716.3.

* cited by examiner

*Primary Examiner* — Alissa Tompkins
*Assistant Examiner* — Xiaoting Hu
(74) *Attorney, Agent, or Firm* — Oblon, Spivak, McClelland, Maier & Neustadt, L.L.P.

(57) ABSTRACT

A power generation apparatus that suppress cavitation includes a first on/off valve provided between a steam generator and an expander in a circulating channel; a bypass channel connected between an area between the steam generator and the first on/off valve and an area between the expander and a condenser; a second on/off valve provided in the bypass channel; a third on/off valve provided between a pump and the steam generator; and a controller. When stopping the pump, the controller outputs a control signal that stops the pump, a control signal that closes the first on/off valve, a control signal that opens the second on/off valve, and a control signal that closes the third on/off valve. In the case where a predetermined condition has been met, the controller outputs a control signal that closes the second on/off valve.

4 Claims, 6 Drawing Sheets

POWER GENERATION APPARATUS

BACKGROUND OF THE INVENTION

1. Field of the Invention

The present invention relates to power generation apparatuses used in electric power generators and the like.

2. Description of the Related Art

Recent years have, due to concerns for energy conservation, seen an increased need for electric power generators that collect so-called "waste heat" from various types of facilities such as factories and generate electricity using the energy from the collected waste heat.

The waste heat electric power generator disclosed in, for example, Japanese Patent No. 4557793 is known as such an electric power generator. This waste heat electric power generator includes a closed-loop circulating channel in which a working fluid evaporator, a turbine for causing the working fluid vapor to expand, a condenser for condensing the working fluid vapor, and pumps for circulating the working fluid are connected in series. Thermal cycling is carried out in the circulating channel when the working fluid is being cycled, while the stated turbine generates power and drives an electric generator using that power. Note that particularly among such waste heat electric power generators, binary generation systems, which use the Rankine cycle to drive turbines, expanders, or the like using a low boiling point working fluid, are well-known.

The stated waste heat electric power generator includes a steam generator that collects waste heat and generates high-pressure working medium vapor from the working medium, a turbine that expands the high-pressure working medium vapor, a condenser that condenses low-pressure vapor from the turbine, and a working medium circulating pump that circulates the working medium. These elements are connected by a working medium circulation channel, and a gas-liquid separator is disposed between the steam generator and the turbine. Working medium vapor that has been separated from the working medium liquid by the gas-liquid separator is introduced into the turbine.

Note that in the stated waste heat electric power generator, it is necessary to provide a circulating pump in order to circulate the working medium through the circulating channel, and liquefied working medium condensed by the condenser located upstream from the circulating pump is sucked into the circulating pump. The circulating pump serves to send the liquefied working medium to the steam generator located downstream.

It is necessary to take measures in order to preempt the occurrence of cavitation in the circulating pump. Cavitation is a phenomenon in which, in a fluid mechanism, the pressure of a medium (liquid) that flows within the fluid mechanism reaches the maximum vapor tension locally, causing the medium to boil and producing small bubbles. When these bubbles are burst, the impact pressure thereof causes what is known as erosion in the constituent components of the fluid mechanism. For example, if the fluid mechanism is a turbo fluid mechanism, the impeller, which is the primary component thereof, will be damaged. In the case where cavitation has occurred in a circulating pump, it is necessary to stop the operation of the entire electric power generator system in order to perform maintenance on the circulating pump. Therefore, it is important to take measures to preempt the occurrence of cavitation in the circulating pump.

In addition to the constituent elements described above, this waste heat electric power generator is provided with a circulation amount control means that controls the amount of the working medium that is to be circulated from the condenser to the steam generator, and a liquid surface detector that detects the surface of the liquid separated in the gas-liquid separator. The separated liquid (working medium) separated by the gas-liquid separator is introduced to the condenser via a flow amount control means, and the circulation amount control means controls the circulation amount of the working medium so that the separated liquid surface within the gas-liquid separator detected by the liquid surface detector reaches a predetermined level.

Furthermore, this waste heat electric power generator is provided with a heat collector. The heat collector is provided along the channel that leads the separated liquid from the gas-liquid separator to the condenser, and exchanges heat between the separated liquid and the working medium fed from the condenser to the steam generator.

Because no measures are taken in the stated waste heat electric power generator to preempt the occurrence of cavitation in the circulating pump, there is the risk that cavitation will occur in the circulating pump.

Note that to prevent the occurrence of cavitation, it is necessary for the channel on the upstream side of the circulating pump to be filled with the liquid-state working medium, and it is further desirable for the amount of the working medium in the liquid state that fills the channel on the upstream side to be greater than or equal to a desired predetermined amount. However, the aforementioned Japanese Patent No. 4557793 makes no particular mention of a method for stopping the waste heat electric power generator or, conversely, a method for starting the waste heat electric power generator. Accordingly, depending on the methods for stopping and starting the waste heat electric power generator, a situation in which the channel on the upstream side of the circulating pump is not filled with the working medium in a liquid state when the waste heat electric power generator is started, or a situation in which the amount of the working medium in a liquid state that fills the channel on the upstream side is less than the desired predetermined amount, will occur. This further increases the risk of cavitation occurring in the circulating pump.

SUMMARY OF THE INVENTION

Having been achieved in light of the stated conventional technology, it is an object of the present invention to provide a power generation apparatus capable of suppressing the occurrence of cavitation in a pump that circulates a working medium without complicating structure.

In order to achieve the aforementioned object, a power generation apparatus according to the present invention includes: a steam generation means that evaporates a liquid working medium by heating the working medium using a thermal medium; an expander that expands the gaseous working medium and produces power as a result; a condensing means that condenses the gaseous working medium by cooling the working medium using a coolant medium; a pump that circulates the working medium; a closed-loop circulating channel in which the steam generation means, the expander, the condensing means, and the pump are connected in series; a first on/off valve provided in the circulating channel between the steam generation means and the expander; a bypass channel connected between an area in the circulating channel between the steam generation means and the first on/off valve and an area between the expander and the condensing means; a second on/off valve provided in the bypass channel; a third on/off valve provided in the circulating channel between the pump and the steam generation means; and a control means that carries out control for starting and stopping the pump and opening and closing the on/off valves. Here, when stopping the pump, the control means outputs a control signal that stops the pump, a control signal that closes the first on/off valve, a control signal that opens the second on/off valve, and a control signal that closes the third on/off valve, and then, in the case where a predetermined condition has been met, outputs a control signal that closes the second on/off valve.

According to the present invention, when stopping the pump, after the second on/off valve is opened, the working medium, which has been heated by the thermal medium in the steam generation means and is thus in a gaseous state flows into the condensing means through the bypass channel, is cooled by the coolant medium in the condensing means, and returns to a liquid state; therefore, by opening the second on/off valve during a period up until a predetermined amount of the liquid-state working medium is accumulated, a state in which the channel upstream from the pump is filled with the liquid-state working medium can be ensured when starting the pump, which makes it possible to reduce the risk of cavitation. Furthermore, the bypass channel having the on/off valve is simply connected to the circulating channel, which makes it possible to avoid complicating the structure.

In addition, in the present invention, it is preferable for the predetermined condition to be that an amount of time has been set in advance by the control means as an amount of time from when the second on/off valve is opened to when a predetermined amount of the liquid working medium has accumulated in the circulating channel upstream from the pump.

According to this configuration, when starting the apparatus, a state in which the channel upstream from the pump is filled with the liquid-state working medium can be ensured, which makes it possible to reduce the risk of cavitation.

In addition, in the present invention, it is preferable for the power generation apparatus to further include a liquid surface meter provided in the condensing means, which is capable of detecting the height of a liquid surface within the condensing means, and for the predetermined condition to be that the value of the liquid surface meter has reached a predetermined value.

According to this configuration, it is objectively determined whether or not the channel upstream from the pump is filled with liquid-state working medium based on the value detected by the liquid surface meter (level gauge), which makes it easy to ensure that a state where the channel upstream from the pump is filled with liquid-state working medium and thus makes it possible to further reduce the risk of cavitation in the pump.

In addition, in the present invention, it is preferable for the power generation apparatus to further include a liquid tank provided in the circulating channel between the condensing means and the pump and a liquid surface meter provided in the liquid tank, the liquid surface meter being capable of detecting the height of a liquid surface within the liquid tank, and for the predetermined condition to be that the value of the liquid surface meter has reached a predetermined value.

According to this configuration, it is objectively determined whether or not the channel upstream from the pump is filled with liquid-state working medium based on the value detected by the liquid surface meter (level gauge), which makes it easy to ensure that a state where the channel upstream from the pump is filled with liquid-state working medium and thus makes it possible to further reduce the risk of cavitation in the pump; furthermore, because the liquid tank is provided, a high amount of liquid-state working medium can be ensured in the channel upstream from the pump.

As described thus far, according to the present invention, the occurrence of cavitation in a pump that circulates a working medium can be suppressed without complicating the structure.

DESCRIPTION OF THE PREFERRED EMBODIMENTS

Embodiments for carrying out the present invention will be described in detail hereinafter with reference to the drawings.

(First Embodiment)

Figure 1:
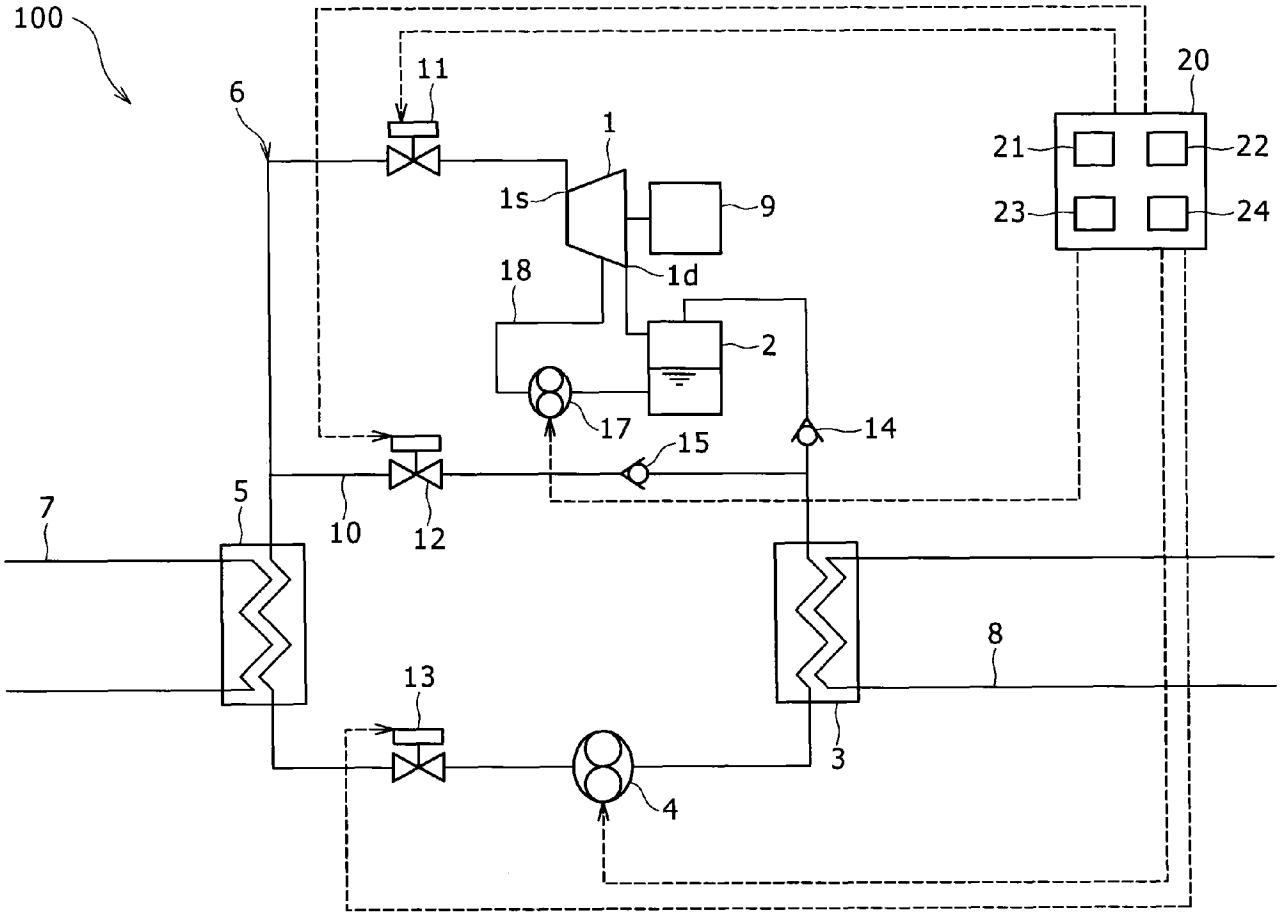
FIG. 1 is a diagram schematically illustrating the configuration of an electric power generator according to a first embodiment of the present invention.

FIG. 1 illustrates the configuration of an electric power generator 100 according to a first embodiment of a power generation apparatus according to the present invention.

The electric power generator 100 includes a closed-loop circulating channel 6 in which are provided an expander 1, an oil separator 2, a condenser (condensing means) 3, a working medium pump 4, and an evaporator (steam generator, steam generation means) 5. A Freon-based medium (for example, R245fa) is injected into the circulating channel 6 as a working medium. A medium with a lower boiling point than that of water is used, and the electric power generator 100 according to the present embodiment is configured as a binary electric power generator.

The expander 1 is disposed downstream from the evaporator 5 in the circulating channel 6, and obtains kinetic energy from the working medium by expanding the working medium evaporated by the evaporator 5 (vapor). The expander 1 is configured of, for example, a screw expander. This screw expander has a pair of male and female screw rotors (not shown) housed within a rotor chamber (not shown) formed in an expander casing, and rotates the screw rotors using the expansion force of the working medium supplied from an intake port is via the circulating channel 6. The working medium that has been expanded in the rotor chamber and whose pressure has dropped is then exhausted to the circulating channel 6 from an exhaust port 1*d*.

The oil separator 2 is provided between the expander 1 and the condenser 3 in the circulating channel 6, and an oil flow channel 18 having an oil pump 17 is provided between the oil separator 2 and the expander 1. The oil separator 2 separates oil that is exhausted from the expander 1 along with the working medium and holds the separated oil in its interior. The oil held in the oil separator 2 is supplied to the interior of the expander 1 via the oil flow channel 18. The oil supplied to the interior of the expander 1 functions as a sealant between the screw rotors and between the screw rotors and the rotor chamber, and works so as to prevent a drop in the efficiency of the expansion of the working medium.

An electric generator 9 is connected to the expander 1, and the electric generator 9 is driven by the power generated by the expander 1 being transmitted to the electric generator 9. The electric generator 9 is configured so that a stator (not shown) and a rotor (not shown) are housed within the internal space of an electric generator casing (not shown). The rotor has a shaft that is integrated with the shaft of the screw rotors in the expander 1, and by rotating along with the rotation of the screw rotors, causes a winding around the stator to generate electricity. The expander 1 and the electric generator 9 configure an electricity generation means.

The condenser 3 is disposed downstream from the expander 1, and more specifically, is disposed downstream from the oil separator 2, in the circulating channel 6; the working medium that has been exhausted into the circulating channel 6 from the exhaust port 1*d* of the expander 1, from which the oil has been separated and is thus in a gaseous state, is introduced into the condenser 3. In the condenser 3, the working medium is condensed through heat exchange with a coolant medium (for example, coolant water) that flows through a coolant medium channel 8 in a system separate from the circulating channel 6, thus becoming a liquid-state working medium. In other words, the condenser 3 includes a channel through which the working medium flows and a channel through which the coolant medium flows, and condenses the working medium by instigating heat exchange between the gaseous working medium and the coolant medium.

The working medium that has become a liquid is pressurized by the pump 4 to a predetermined pressure, and is then sent to the evaporator 5. In the evaporator 5, the working medium is heated through heat exchange with a thermal medium (for example, a low-pressure vapor) that flows through a thermal medium channel 7 in a system separate from the circulating channel 6, thus becoming a saturated vapor (or a superheated vapor). In other words, the evaporator 5 includes a channel through which the working medium flows and a channel through which the thermal medium, which is supplied from an external heat source, flows, and vaporizes the working medium into a saturated vapor (or a superheated vapor) by instigating heat exchange between the working medium in a liquid state and the thermal medium. The working medium that has been turned into a saturated vapor (or a superheated vapor) by the evaporator 5 is once again supplied to the expander 1.

In addition to vapor gathered from wells (steam wells) and excess heat exhausted from factories or the like, vapor generated by facilities such as a concentrator that uses solar heat as its heat source, a boiler that uses biomass, fossil fuels, and the like as its heat source, and so on can be considered as the thermal medium (heating medium) supplied to the evaporator 5 via the thermal medium channel 7. On the other hand, coolant water created by cooling towers can be considered as the coolant medium supplied to the condenser 3 via the coolant medium channel 8.

The pump 4 is provided for circulating the working medium within the circulating channel 6, and is disposed downstream from the condenser 3 in the circulating channel 6. In other words, the pump 4 is provided in the circulating channel 6 so as to connect the condenser 3 and the evaporator 5, and takes in the working medium (liquid) from the condenser 3 side and ejects the working medium to the evaporator 5 side. A centrifugal pump that uses an impeller as its rotor, a gear pump in which the rotor is configured of a pair of gears, or the like can be used favorably as the pump 4.

A first on/off valve 11 (V1) is provided between the evaporator 5 and the expander 1 in the circulating channel 6. Meanwhile, a bypass channel 10 is provided in the circulating channel 6 so as to connect the area downstream from the evaporator 5 and the area upstream from the condenser 3; more specifically, the bypass channel 10 is connected from between the evaporator 5 and the first on/off valve 11 to between the expander 1 and the condenser 3. A second on/off valve 12 (V2) is provided in the bypass channel 10. Furthermore, a third on/off valve 13 (V3) is provided in the circulating channel 6 between the pump 4 and the evaporator 5.

A check valve 14 that only allows a flow from the oil separator 2 to the condenser 3 is provided upstream from the condenser 3 in the circulating channel 6, in a location that is further upstream from the area where the circulating channel 6 and the bypass channel 10 are connected. In addition, a check valve 15 that only allows a flow from the downstream side of the evaporator 5 toward the upstream of the condenser 3 is provided downstream from the second on/off valve 12 in the bypass channel 10.

The electric power generator 100 includes a control unit (control means) 20. The control unit 20 includes an input/display means (not shown) such as a touch panel. The control unit 20 also includes a ROM, a RAM, a CPU, and so on, and can carry out predetermined functions by executing programs stored in the ROM. In other words, a setting unit 21, a start control unit 22, a stop control unit 23, and a determination unit 24 are included as functions of the control unit 20.

The setting unit 21 outputs a setting signal to the RAM so that a predetermined value of a timer, mentioned later, is set to a value inputted through the input/display means. The RAM receives the setting signal sent from the setting unit and stores the predetermined value. The start control unit 22 outputs a control signal for opening the first on/off valve 11 and the third on/off valve 13 and a control signal for starting the oil pump 17 and the pump 4 when a start command is generated through operations performed using the input/display means. The stop control unit 23 outputs a control signal for closing the first on/off valve 11, a control signal for stopping the oil pump 17 and the pump 4, and a control signal for closing the third on/off valve 13, as well as a control signal for opening the second on/off valve 12, when a stop command is generated through operations performed using the input/display means. The determination unit 24 includes a timer that counts the time from when the start command is generated, and determines whether or not the timer value fulfills a predetermined condition set by the setting unit 21, or in other words, whether or not the predetermined value stored in the RAM has been reached.

Figure 2:
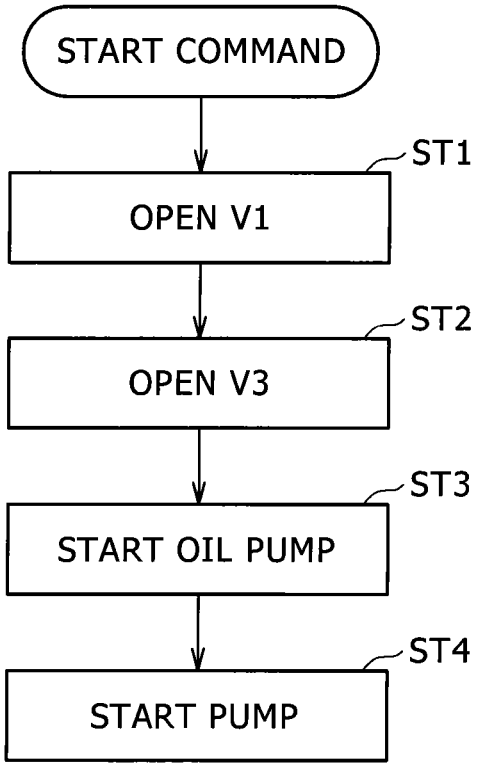
FIG. 2 is a flowchart illustrating operations performed when starting the electric power generator.

Here, control operations performed when starting the electric power generator 100 will be described with reference to FIG. 2.

When a start command is generated by the input/display means of the control unit 20 being manipulated, the start control unit 22 of the control unit 20 opens the first on/off valve 11 and the third on/off valve 13 (step ST1 and step ST2) and starts the oil pump 17 and the pump 4 (step ST3 and step ST4). Note that step ST1 through step ST4 may be carried out in any order, and may all be carried out simultaneously.

As a result, the liquid-state working medium sent from the pump 4 is evaporated in the evaporator 5, becomes a saturated vapor (or a superheated vapor) as a result, is supplied to the expander 1, and is expanded by the expander 1. At this time, the electric generator 9 obtains power from the expander 1 and is driven as a result. The working medium exhausted from the expander 1 is condensed by the condenser 3, returns to a liquid state, and is taken in by the pump 4. The working medium is circulated through the circulating channel 6 in this manner. At this time, because the second on/off valve 12 is a normally-closed on/off valve and is in a closed state at startup, the working medium does not flow through the bypass channel 10 at startup.

Next, control operations performed when stopping the electric power generator 100 will be described with reference to FIG. 3.

When a stop command is generated by the input/display means of the control unit 20 being manipulated, the stop control unit 23 of the control unit 20 closes the first on/off valve 11 and stops the pump 4 and oil pump 17 (step ST10), and also opens the second on/off valve 12 and closes the third on/off valve 13 (step ST11). The timer in the determination unit 24 of the control unit 20 is then started (step ST12). Note that step ST10 through step ST12 may be carried out in any order, and may all be carried out simultaneously.

After this, the control unit 20 determines whether the value of the timer in the determination unit 24 has reached the predetermined value set in advance by the setting unit 21 (that is, determines whether or not a predetermined amount of time has passed after the pump 4 has been stopped, the second on/off valve 12 has been opened, and the third on/off valve 13 has been closed) (step ST13).

Step ST13 is repeated until the value of the timer reaches the predetermined value, and when it has been determined that the value of the timer has reached the predetermined value, the determination in step ST13 is YES, and the process moves to step ST14. Then, the second on/off valve 12 is closed based on a control signal from the control unit 20 (step ST14), and the stopping process ends.

Now, the behavior of the working medium when the pump 4 is stopped as described above will be discussed. When the first on/off valve 11 and third on/off valve 13 are closed and the pump 4 is stopped (step ST10, step ST11), the flow of the working medium is stopped in the section of the circulating channel 6 that spans from the exit of the condenser 3 to the entrance of the evaporator 5. Through this, gaseous-state working medium and liquid-state working medium accumulate in both the evaporator 5 and the condenser 3. At this time, the thermal medium continues to flow in the thermal medium channel 7, and the coolant medium continues to flow in the coolant medium channel 8. Accordingly, the working medium continues to be heated by the thermal medium in the evaporator 5, and thus the liquid-state working medium in the evaporator 5 continues to evaporate. As a result, the pressure within the evaporator 5 reaches a maximum vapor tension; for example, the temperature of the working medium within the evaporator 5 is 80° C., and a pressure P1 thereof is 0.789 MPa. On the other hand, the working medium continues to be cooled by the coolant medium in the condenser 3, and thus the gaseous-state working medium in the condenser 3 continues to condense. The temperature of the working medium within the condenser 3 is, for example, 20° C., and a pressure P2 thereof is 0.124 MPa. At this time, the second on/off valve 12 is open (step ST11), and thus due to the difference between the pressure in the evaporator 5 and the pressure in the condenser 3, the working medium within the evaporator 5, which is primarily in a gaseous state, flows into the condenser 3 through the bypass channel 10, and condenses in the condenser 3. Furthermore, because the second on/off valve 12 is opened only for the pre-set predetermined amount of time, a predetermined amount of liquid-state working medium accumulates in the condenser 3 in that predetermined amount of time. Note that the predetermined amount of time changes depending on the size of the evaporator 5, the diameter and volume of the piping of the circulating channel 6 from the pump 4 to the evaporator 5, and so on. The predetermined amount of time is a time found through experimentation, analysis, or the like, and is a time that is set in advance by the setting unit 21 of the control unit 20 as the amount of time required for the predetermined amount of working medium to accumulate in the condenser 3 under a variety of conditions.

As described thus far, according to the present embodiment, after the second on/off valve 12 is opened when stopping the pump 4, the working medium that has been heated by the thermal medium in the evaporator 5 and is thus in a gaseous state flows to the condenser 3 through the bypass channel 10, is cooled by the coolant medium in the condenser 3, and returns to a liquid state; thus by opening the second on/off valve 12 for the predetermined amount of time until the predetermined amount of the liquid-state working medium has accumulated, the risk of cavitation occurring in the working medium taken in by the pump 4 can be reduced when starting the pump 4.

(Second Embodiment)

Figure 4:
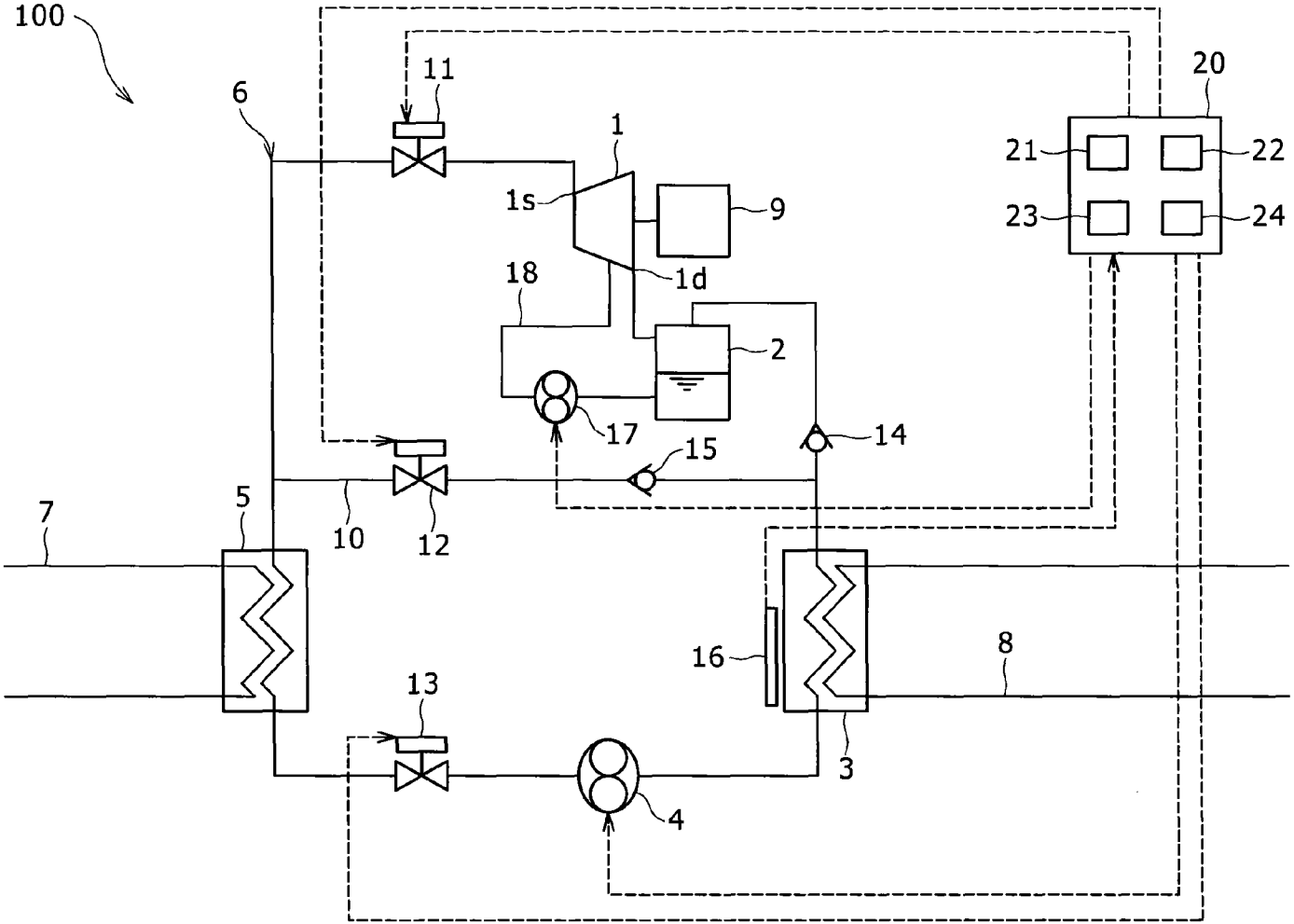
FIG. 4 is a diagram schematically illustrating the configuration of an electric power generator according to a second embodiment of the present invention.

FIG. 4 illustrates the configuration of an electric power generator 100 according to a second embodiment of a power generation apparatus according to the present invention. Note that the second embodiment will describe only points that differ from the first embodiment, and descriptions of configurations, actions, and effects that are the same as in the first embodiment will be omitted.

In the electric power generator 100 according to the second embodiment, in addition to the constituent elements of the electric power generator 100 according to the first embodiment, the condenser 3 is provided with a liquid surface meter (level gauge) 16 capable of detecting the height of the liquid surface therein. Furthermore, the setting unit 21 in the control unit 20 outputs a setting signal to the RAM so that a predetermined value of the liquid surface meter (level gauge) 16 is set to a value inputted through the input/display means. The determination unit 24 of the control unit determines whether or not the value detected by the liquid surface meter (level gauge) 16 fulfills a predetermined condition set in advance by the setting unit 21, or in other words, whether or not the predetermined value stored in the RAM has been reached.

Figure 5:
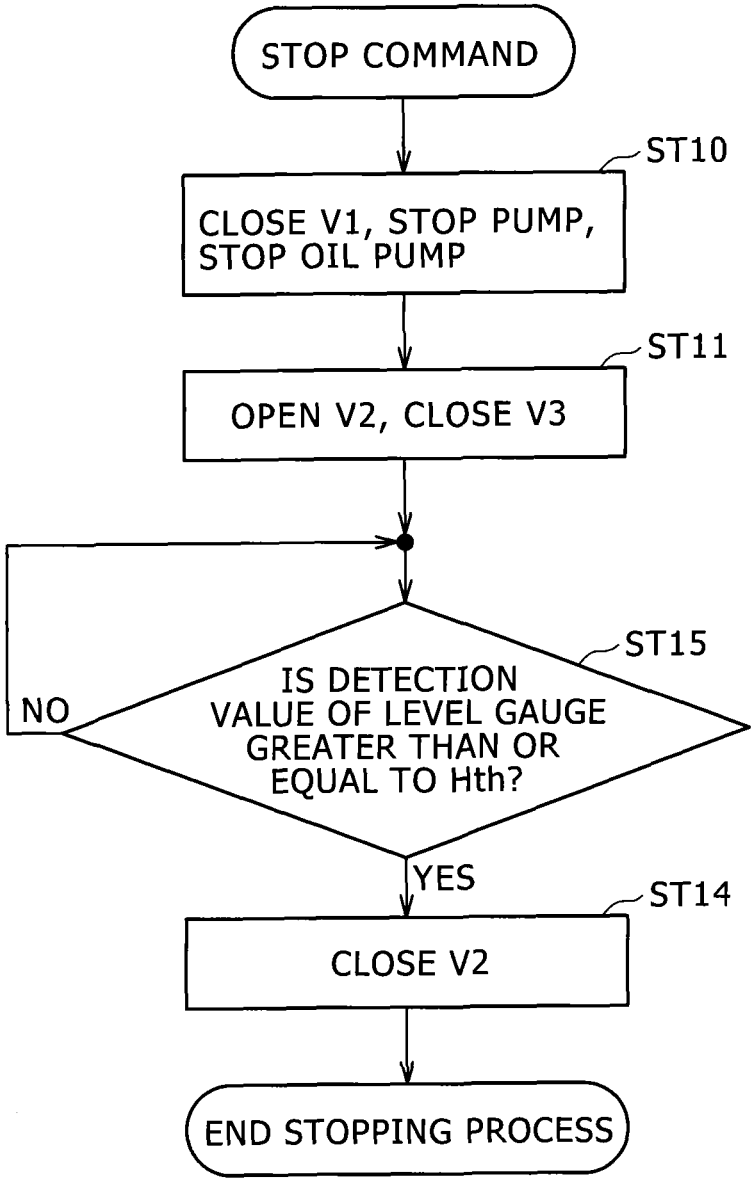
FIG. 5 is a flowchart illustrating operations performed when stopping the electric power generator.

Next, control operations performed in the present embodiment will be described. Here, control operations performed during stopping, which are different from those described in the first embodiment, will be described with reference to FIG. 5.

Figure 3:
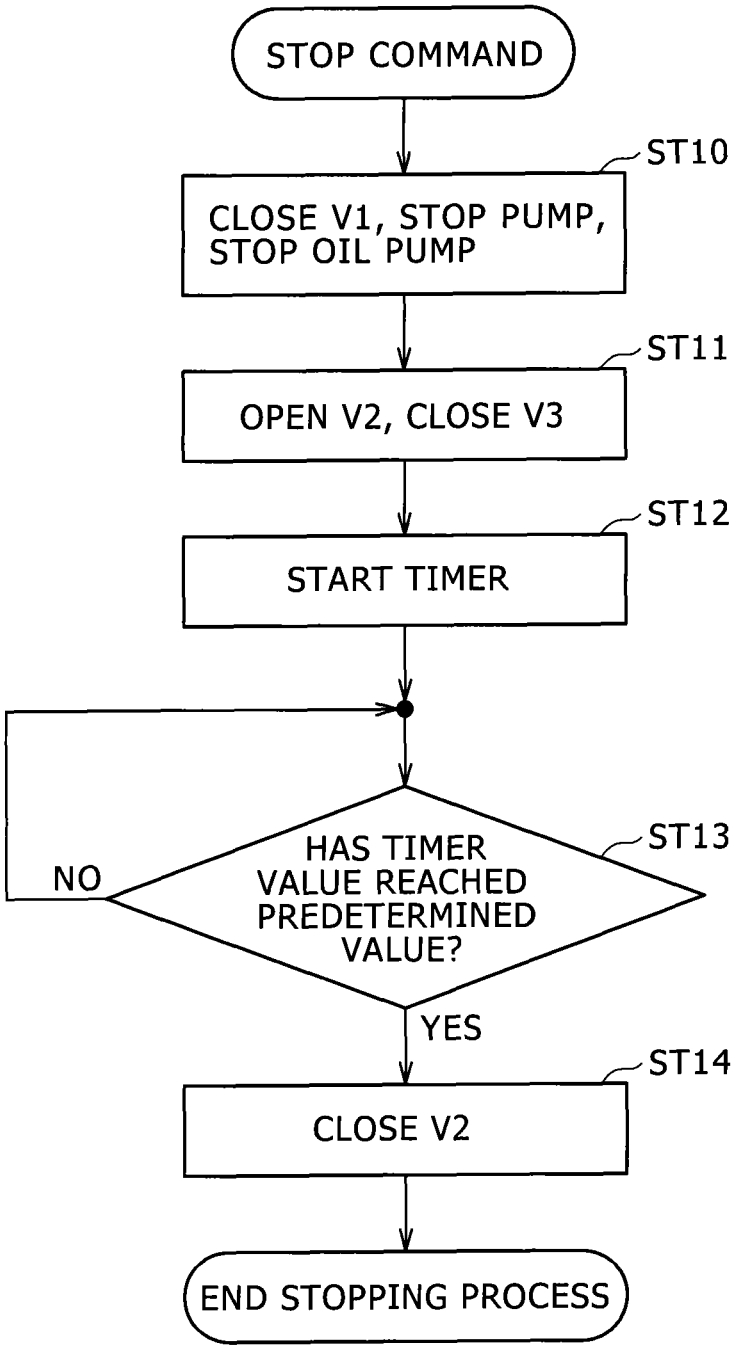
FIG. 3 is a flowchart illustrating operations performed when stopping the electric power generator.

With the electric power generator 100 according to the present embodiment, when stopping the pump 4, instead of step ST12 and step ST13 of FIG. 3, which use the timer in the control operations performed when stopping the electric power generator 100, step ST15, in which it is determined whether or not the detection value of the level gauge is greater than or equal to Hth (that is, whether or not the liquid surface has reached a predetermined liquid surface height), is executed. Here, Hth is a value found through experimentation, analysis, or the like, and is a value set in advance in the setting unit 21 of the control unit 20.

In other words, with the electric power generator 100 according to the second embodiment, when a stop command is generated by the input/display means of the control unit 20 being manipulated, the stop control unit 23 of the control unit 20 closes the first on/off valve 11 and stops the pump 4 and oil pump 17 (step ST10), and also opens the second on/off valve 12 and closes the third on/off valve 13 (step ST11). Note that step ST10 and step ST11 may be carried out in any order, and may be carried out simultaneously.

After this, the determination unit 24 of the control unit 20 determines whether or not the value of the liquid surface meter (level gauge) 16 has reached the predetermined value Hth set in advance by the setting unit 21 (step ST15).

Step ST15 is repeated until the value of the liquid surface meter (level gauge) has reached the predetermined value Hth, and when it has been determined that the value of the liquid surface meter (level gauge) has reached the predetermined value Hth, the determination in step ST15, and the process moves to step ST14. Then, the second on/off valve 12 is closed based on a control signal from the control unit 20 (step ST14), and the stopping process ends.

Although the behavior of the working medium when the pump 4 is stopped as described above is the same in the present embodiment as in the first embodiment, in the present embodiment, it is objectively determined whether or not the channel upstream from the pump 4 is filled with liquid-state working medium based on the value detected by the liquid surface meter (level gauge) 16. Accordingly, a state where the channel upstream from the pump 4 is filled with liquid-state working medium can be ensured with more certainty than in the first embodiment, and the risk of cavitation occurring when starting the pump can be reduced even further.

(Third Embodiment)

Figure 6:
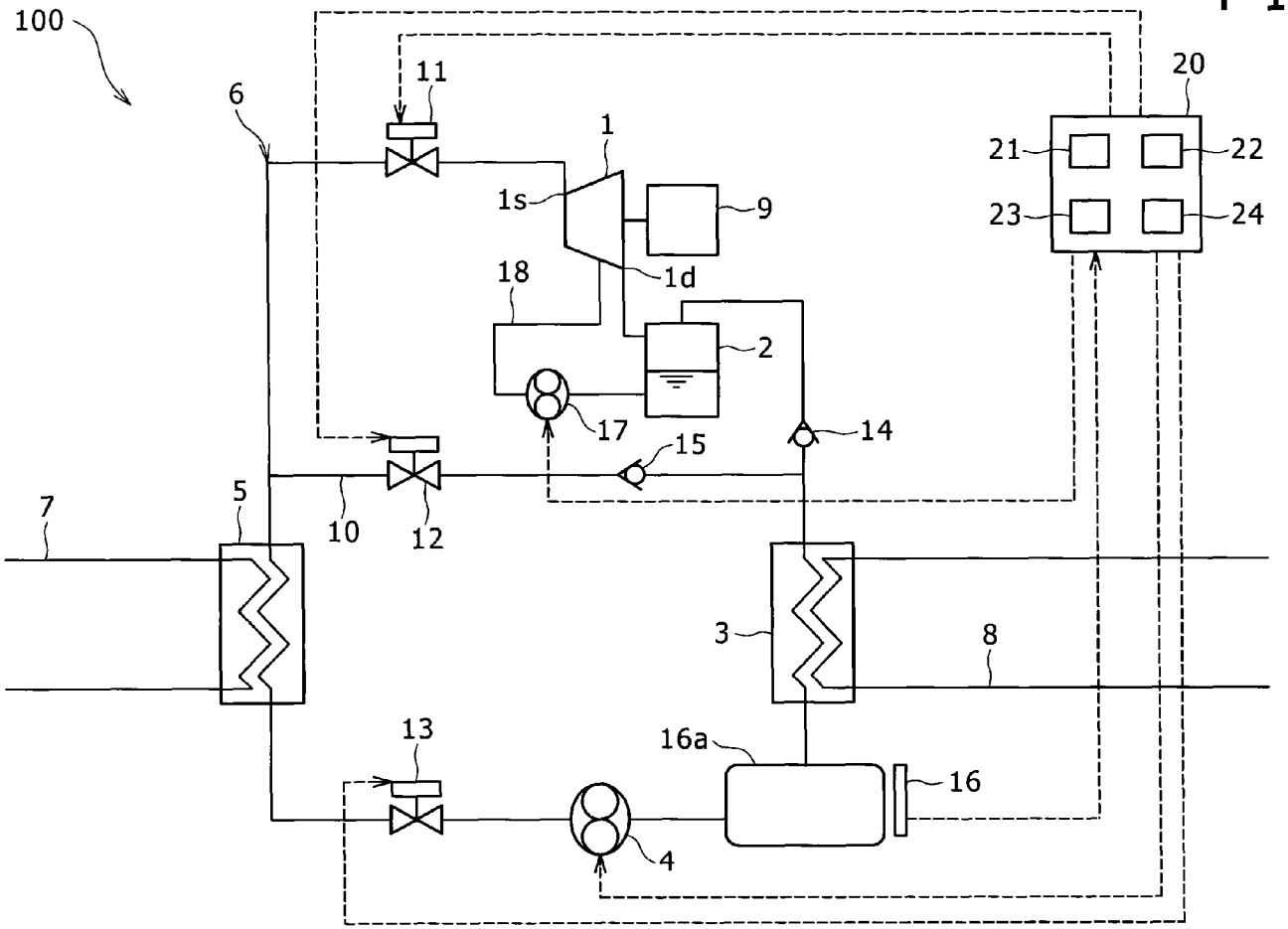
FIG. 6 is a diagram schematically illustrating the configuration of an electric power generator according to a third embodiment of the present invention.

FIG. 6 illustrates the configuration of an electric power generator 100 according to a third embodiment of a power generation apparatus according to the present invention. Note that the third embodiment will describe only points that differ from the second embodiment, and descriptions of configurations, actions, and effects that are the same as in the first embodiment and the second embodiment will be omitted.

In the electric power generator 100 according to the third embodiment, in addition to the constituent elements of the electric power generator 100 according to the second embodiment, a liquid tank 16*a* is provided in the circulating channel 6 between the condenser 3 and the pump 4, and the liquid surface meter (level gauge) 16 is provided in the liquid tank 16*a* rather than in the condenser 3.

The control operations performed when starting and stopping the pump 4 of the electric power generator 100 according to the present embodiment are the same as in the second embodiment.

Accordingly, in the present embodiment as well, a state where the channel upstream from the pump 4 is filled with liquid-state working medium can be ensured with more certainty than in the first embodiment, and the risk of cavitation occurring when starting the pump can be reduced even further. Furthermore, because the liquid tank 16*a* is provided in the present embodiment, a greater amount of liquid working medium can be secured for the channel upstream from the pump 4 than in the second embodiment.

Note that the descriptions disclosed in the above embodiment are to be understood as being in all ways exemplary and in no way limiting. The scope of the present invention is defined by the appended claims rather than the descriptions of the aforementioned embodiments, and many modifications may be made within the same scope as the appended claims.

For example, in the first through third embodiments, on/off valves may be provided in the thermal medium channel 7 and the coolant medium channel 8 in a manner that the on/off valves in the channels 7 and 8 are closed as the second on/off valve 12 is opened. Alternatively, the on/off valves in the thermal medium channel 7 and the coolant medium channel 8 may be closed as the pump 4 is stopped.

Furthermore, the oil separator 2 can be omitted depending on the type of the expander 1.

Finally, the target of the driving performed by the power generation apparatus according to the present invention is not limited to electric generators.

What is claimed is:

1. A power generation apparatus comprising:

an evaporator that evaporates a liquid working medium by heating the working medium using a thermal medium;

an expander that expands the gaseous working medium and produces power as a result;

a condenser that condenses the gaseous working medium by cooling the working medium using a coolant medium;

a pump that circulates the working medium;

a closed-loop circulating channel in which said evaporator, said expander, said condenser, and said pump are connected in series;

a first on/off valve provided in said circulating channel between said evaporator and said expander;

a bypass channel connected between an area in said circulating channel between said evaporator and said first on/off valve and an area between said expander and said condenser;

a second on/off valve provided in said bypass channel;

a third on/off valve provided in said circulating channel between said pump and said evaporator; and a controller comprising:

means for starting said pump, means for stopping said pump, means for closing said first and third on/off valves, and for opening said second on/off valve, upon stopping said pump, means for determining if a predetermined condition has been met after the time of opening said second on/off valve, and means for closing said second on/off valve when the predetermined condition has been met after the time of opening said second on/off valve.

2. The power generation apparatus according to claim 1, wherein the controller further comprises a timer, and the predetermined condition is that the timer determines that an amount of time that has been set in advance by said controller as the amount of time from when said second on/off valve is opened to when a predetermined amount of the liquid working medium has accumulated in said circulating channel upstream from said pump, has elapsed.

3. The power generation apparatus according to claim 1, further comprising:

a liquid surface meter, provided in said condenser, that is capable of detecting a height of a liquid surface within said condenser, wherein the predetermined condition is that a value of said liquid surface meter has reached a predetermined value.

4. The power generation apparatus according to claim 1, further comprising:

a liquid tank provided in said circulating channel between said condenser and said pump and a liquid surface meter provided in said liquid tank, said liquid surface meter being capable of detecting a height of a liquid surface within said liquid tank, wherein the predetermined condition is that a value of said liquid surface meter has reached a predetermined value.

* * * * *